United States Patent [19]

Ayukawa et al.

[11] Patent Number: 4,675,054

[45] Date of Patent: Jun. 23, 1987

[54] PROCESS FOR TREATING METAL SURFACE

[75] Inventors: Nobuhiro Ayukawa, Kamakura; Yasuhiko Konishi, Yamato, both of Japan

[73] Assignee: Nippon Dacro Shamrock Co., Ltd., Japan

[21] Appl. No.: 861,325

[22] Filed: May 9, 1986

[30] Foreign Application Priority Data

May 22, 1985 [JP] Japan ..... 60-108423

[51] Int. Cl.[4] ..... C23C 22/26

[52] U.S. Cl. ..... 148/6.2

[58] Field of Search ..... 148/6.2

[56] References Cited

U.S. PATENT DOCUMENTS 3,285,788 11/1966 Suadlenak ..... 148/6.2

4,257,828 3/1981 Weda ..... 148/6.2

*Primary Examiner*—Sam Silverberg

*Attorney, Agent, or Firm*—Webb, Burden, Robinson & Webb

[57] ABSTRACT

In the process of chromate treatment, a metallic material which has been immersed in a chromate treatment solution is allowed to stand in an atmosphere substantially free from any ingredient of the chromate treatment solution for at least 30 seconds and then washed with a halocarbon or a mixture of a halocarbon and an alcohol the chromate treatment solution before drying. By the procedure chromium is evenly and uniformly taken up on the surface of the metallic material and the amount of chromium taken up on the surface can be controlled by conditions of standing in said atmosphere.

10 Claims, No Drawings

PROCESS FOR TREATING METAL SURFACE

FIELD OF THE INVENTION

This invention relates to a process for anti-corrosion treatment of metal surface. More particularly, this invention relates to an improvement of the non-aqueous chromate treatment.

BACKGROUND OF THE INVENTION

Chromate treatment or chromating of metal surface for corrosion prevention is well known. Chromate treatment was traditionally carried out with an aqueous system, that is, an aqueous solution of chromic acid. Recently, however, non-aqueous chromate treatment, in which a halocarbon solvent is used as the medium, has been prevailing, since it does not produce harmful aqueous waste and thus no large scale waste soution treatment equiment is required. Typical techniques are disclosed in U.S. Pat. No. 3,285,788 (Du Pont), Japanese Laid-Open Patent Publication No. 56-62970 (Tokuyama Soda), Japanese Patent Application No. 59-153028 (Nippon Dacro Shamrock K.K.), etc.

The non-aqueous chromate treatment solution comprises a non-combustible halocarbon (a hydrocarbon some or all of the hydrogen atoms of which are replaced with halogen atoms) containing an alcohol as a solubilizer, in which anhydrous chromic acid is dissolved. The solution may contain a stabilizer for the purpose of decomposition prevention and a reaction promotor if desired.

The non-aqueous chromate treatment has conventionally been carried out by contacting a cleansed metal surface with a chromating solution by dipping, spraying, etc., and immediately drying the metal surface. Usually the treating solution is kept at its boiling temperature, the metallic material which has been heated to that temperature by contact with the treating solution such as by dipping is immediately taken out of the solvent vapor layer and is dried spontaneously or forcedly. In this, there occurs a disadvantage that chromic acid is taken up unevenly on the metal surface, and spots and speckles are formed on the surface. If the surface is washed with a solvent or solvent vapor after contact with the treating solution, the chromic acid which has been taken up on the surface is lost and only a small amount of chromic acid remains. In order to retain a significant amount of chromic acid even if the treated surface is washed, an extremely long time is required for the reaction. It was practically impossible to effect washing with a solvent in the prior art and it was very difficult to control the amount of chromic acid taken up. Therefore, washing is not carried out in the conventional non-aqueous process.

In the course of our study to solve the above-mentioned problems in the non-aqueous chromate treatment, we have found that the chromic acid taken up on the metal surface is not lost and only the chromic acid portions taken up unevenly and excessively are removed and a good finish is attained by allowing the metallic material which has been contacted with the treating solution to stand for a short time in an atmosphere which substantially does not contain vapor of any ingredient of the treating solution before washing. Further we have found that the amount of chromic acid to be taken up can be controlled by regulating the condition under which the treated metallic material is allowed to stay in said atmosphere, and thereby attained this invention.

DISCLOSURE OF THE INVENTION

This invention provides an improved process of chromate treatment (chromating) comprising contacting a metal surface with a chromating solution comprising a chromic acid ingredient, a halocarbon solvent and an alcohol solubilizing agent which may contain a stabilizer and/or a reaction promoter; allowing the thus treated metallic material to stand in an atmosphere substantially free from any ingredient of the above-mentioned chromating solution (setting) for at least 30 seconds; thereafter washing the metal surface by contacting a liquid and/or vapor of a solution substantially consisting of a halocarbon or a halocarbon and an alcohol; and drying it.

In the process of this invention the term "setting" means allowing the metallic material which has been contacted with the chromate treatment solution to stand for at least 30 seconds in an atmosphere free from vapor of any ingredient of the treatment solution.

According to this invention, the amount of chromic acid to be taken up on the metal surface can be controlled as desired and chromate-treated products having an attractive appearance can be obtained without losing advantages of the conventional non-aqueous chromate treatment process.

SPECIFIC DESCRIPTION OF THE INVENTION

The halocarbon solvent in the chromate treatment solution used in the process of this invention is a hydrocarbon having not more than 2 carbon atoms of which hydrogen atoms are replaced with halogen (usually fluorine and chlorine) atoms and includes those of which all the hydrogen atoms are replaced. Typical examples thereof are methylene chloride, chloroform, carbon tetrachloride, trichloroethane, trichloroethene, perchloroethylene, trichloromonofluoromethane dichlorotetrafluoroethane, trichlorotrifluoroethane, tetrachlorodifluoroethane and mixtures thereof.

The chromic acid ingredient is preferably a substance represented by the chemical formula $CrO_3$, referred to as anhydrous chromic acid or chromium trioxide. However, other hexavalent chromium compounds can also be used.

The chromic acid ingredient is used in an amount of 0.01–10 parts by weight (hereinafter simply referred to as "parts") per 100 parts of a halocarbon solvent.

The solubilizer is a secondary or tertiary alcohol having 3–20 carbon atoms which is soluble in the above-described halocarbons. Usually secondary propanol, tertiary butanol, tertiary amyl alcohol, triphenylcarbinol, etc. can suitably be used. Especially tertiary butanol (described as t-butanol hereinafter) is preferred. The solubilizer is used in an amount of at least 1 part per 100 parts of a halocarbon. This ingredient is used to solubilize the chromic acid ingredients and other ingredients in the halocarbon and a necessary amount thereof is added to the halocarbon. Use of too large an amount thereof may make the composition combustible under some condition. Usually not more than 20 parts per 100 parts of halocarbon suffices.

The stabilizer includes amine compounds, quinone compounds, nitro compounds, azo or azoxy compounds, thio compounds, diene compounds, organic nitrite salts, zinc fluoride, zinc oxide, etc. These can be used in combination. The stabilizer is usually used in an amount of 0.001–5 parts per 100 parts of halocarbon.

The reaction promoter includes hydrogen flouride, organic acids, water, etc. They can be used singly or in combination. The reaction promoter is usually used in an amount of not less than 0.001 part per 100 parts of halocarbon. In the case of hydrogen fluoride or an organic acid, it is preferably used in an amount of not more than 0.12 part per 100 parts of halocarbon. In the case of water, it is preferably used within a limit that allows a homogeneous system to be maintained.

The above-described chromate treatment solution is known per se. No more detailed description is required.

The process of this invention is preferably carried out as follows. A metallic material to be treated is contact with a treatment solution kept at a temperature from 5° C. to the boiling point thereof for a period of 1 second to 60 minutes, preferably 30 seconds to 5 minutes, and the metallic material is allowed to stand for at least 30 seconds in an atmosphere substantially free from vapor of any ingredient of the treatment solution (this step is called "setting" as mentioned before). Thereafter, the thus treated metallic material is contacted with the liquid and/or vapor of a solution substantially consisting of a halocarbon and a solubilizer. The process of the present invention is characterized in the setting and washing.

The setting is usually effected by allowing the metallic material which has been contacted with a chromate treatment solution to stand in the air of ordinary temperature for period of not less than 30 seconds. However, it is very effective if it is carried out at an elevated temperature or in the flow of air as illustrated in some working examples described hereinafter. The setting is preferably carried out in the flow of air of 20° C. to 50° C. The setting is carried out for 30 seconds to 60 minutes, preferably for 1 to 10 minutes.

(WORKING EXAMPLES)

Now the invention will be described in detail by way of working examples and comparative examples. However, the invention is not limited to such examples.

Test panels were washed and degreased with trichloroethane or trichlorotrifluoroethane, etc. and then treated with a non-aqueous chromate treatment solution. Appearance of the thus treated test panels was observed, the amount of the chromic acid taken up was measured and the test pieces were subjected to corrosion test. The amount of chromic acid taken up and corrosion resistance were measured by the following methods.

The amount of the chromic acid taken up was measured with a fluorescent X-ray analyzer ("Portaspec" manufactured by Hankison Corp.). Chromium is also detected from untreated test pieces, and therefore the blank value was subtracted from the measured counts.

Corrosion was tested using a salt spray test apparatus manufactured by Suga Shikenki K.K. in accordance with the method of ASTM B 117. Time until generation of rust was measured.

EXAMPLE 1

Mild steel test panels (70×150×0.8 mm, supplied by Nippon Test Panel K.K.) were immersed for 3 minutes in a treatment solution prepared by homogeneously mixing 100 parts of trichloroethane, 0.5 part of anhydrous chromic acid, 0.01 part of zinc fluoride, and 10 parts of t-butyl alcohol at its refluxing temperature. The thus treated panels were allowed to stand in fresh air for 3 minutes (setting). Then they were dipped in a washing solution consisting of 100 parts of trichloroethene and 5 parts of t-butanol at ordinary temperature, and were dried by contacted with the vapor of boiling trichloroethane until the panels themselves were heated to the vapor temperature and were dried. Properties of the thus treated panels were checked, and the results are shown in Table 1.

COMPARATIVE EXAMPLE 1

The same mild steel test panels were treated in the same manner as in Example 1 except that the setting was omitted and the properties of the treated panels were checked. The results are shown in Table 1. The amount of chromium taken up on the metal surface is very low and the corrosion resistance was inferior in comparison with the panels of Example 1.

EXAMPLE 2

Electrogalvanized mild steel test panels (70×150×0.8 mm, thickness of zinc layer: 8μ, without chromating) were immersed in a treatment solution prepared by homogeneously mixing 100 parts of methylene chloride, 15 parts of t-butanol, 2 parts of anhydrous chromic acid and 0.005 part of zinc fluoride and 0.1 part of parabenzoquinone, the latter two being stabilizers, for 3 minutes at the refluxing temperature. The thus treated panels were allowed to stand in a nitrogen gas flow for 1 minute (setting). Then they were contacted with the vapor of boiling methylene chloride until the panels themselves were heated to the vapor temperature, and dried. Properties of the resulting panels were checked, and the results are shown in Table 1.

COMPARATIVE EXAMPLE 2

The same electrogalvanized mild steel test panels were treated in the same manner as in Example 2 except that the setting step was omitted and the properties of the resulting panels were checked. The results are shown in Table 1. They are remarkably inferior to the panels of Example 2 in appearance, amount of the chromium taken up and corrosion resistance.

EXAMPLE 3

The same electrogalvanized mild steel test panels were treated in the same manner as in Example 2 except that the test panels were immersed in the treatment solution at 20° C., which is far lower than the refluxing temperature. The properties of the resulting panels were checked and the results are shown in Table 1.

COMPARATIVE EXAMPLE 3

The same electrogalvanized mild steel test panels were treated in the same manner as in Example 3 except that the setting step was omitted. Properties of the resulting panels were checked and the results are shown in Table 1.

EXAMPLE 4

Aluminum panels (AA 4032, 70×150×1.0 mm, supplied by Nippon Test Panel K.K.) were immersed in a treatment solution prepared by homogeneously mixing 100 parts of trichlorotrifluoroethane, 15 parts of t-butanol, 2 parts of anhydrous chromic acid and 0.01 part of oxalic acid for 3 minutes at the refluxing temperature. The thus treated panels were allowed to stand in a stream of fresh air at the flow rate of 0.5 m/sec for 3 minutes (setting). Then they were dipped in a boiling washing solution consisting of 96 parts of trichlorotrifluoroethane and 4 parts of t-butanol, and were dried above the vapor layer. Properties of the thus treated panels were checked and the results are shown in Table 1.

COMPARATIVE EXAMPLE 4

The same aluminum panels were treated in the same manner as in Example 4 except that the setting step was omitted. Properties of the resulting panels were checked, and were found to be somewhat inferior to the panels of Example 4 in appearance and remarkably inferior to them in the amount of chromium taken up and corrosion resistance. Refer to Table 1.

TABLE 1

| Examples & Comparative Examples | Materials Treated | Steps* | Appearance** | Amount of Chromium Taken Up (counts) | Salt Spray*** Test (hr.) |
|---|---|---|---|---|---|
| Ex. 1 | Mild steel sheet | Reaction-Setting-Washing-Drying | o | 8200 | 72 |
| Comp. Ex. 1 | Mild steel sheet | Reaction-Washing-Drying | Δ | 900 | 24 |
| Ex. 2 | Electrogalvanized sheet | Reaction-Setting-Washing-Drying | o | 20300 | 192 |
| Comp. Ex. 2 | Electrogalvanized sheet | Reaction-Washing-Drying | × | 3800 | 96 |
| Ex. 3 | Electrogalvanized sheet | Reaction-Setting-Washing-Drying | o | 19700 | 192 |
| Comp. Ex. 3 | Electrogalvanized sheet | Reaction-Washing-Drying | × | 1500 | 48 |
| Ex. 4 | Aluminum sheet | Reaction-Setting-Washing-Drying | o | 35100 | 480 (Normal) |
| Comp. Ex. 4 | Aluminum sheet | Reaction-Washing-Drying | Δ | 1800 | 168 (White Rust) |

*"Reaction" means the step of immersing in a treatment solution.
"Washing" means the step of immersing in a washing solution.
"Drying" means the step of keeping the panel above the vapor phase then removal therefrom.
**o stands for "good".
Δ stands for "relatively poor".
x stands for "poor".
***Hr. stands for hours until red rust is generated. In the case of aluminum sheet, it means hours until white rust is generated.

EXAMPLE 5

Mild steel test panels (100×150×2.3 mm, supplied by Nippon Test Panel K.K.) which were coated with zinc by means of mechanical plating as disclosed in Japanese Laid-Open Patent Publication No. 56-45372 were immersed in a treatment solution prepared by homogeneously mixing 100 parts of trichlorotrifluoroethane, 15 parts of t-butanol, 2 parts of anhydrous chromic acid and 0.01 part of oxalic acid for 3 minutes at the refluxing temperature. The thus treated panels were subjected to the setting under varied conditions in air flow. Then they were dipped in a boiling solution consisting of 96 parts of trichlorotrifluoroethane and 4 parts of t-butanol and dried above the vapor layer. Properties of the resulting panels were checked and the results are shown in Table 2.

COMPARATIVE EXAMPLE 5

The procedure of Example 5 was repeated except that the step of setting was omitted. Properties of the resulting panels were checked. They were remarkably inferior to those of Example 5 in appearance, amount of chromium taken up and corrosion resistance. Refer to Table 2.

TABLE 2

| Examples | Steps* | Conditions of Setting: Temp. (°C.) | Time (min) | Air Flow (m/sec) | Performance Tests**: Appearance | Amount of Chromium Taken Up (counts) | Salt Spray Test (hr.) |
|---|---|---|---|---|---|---|---|
| Ex. 5 A | Reaction-Setting-Washing-Drying | 5 | 1 | 0.7 | o | 9100 | 408 |
| B | Reaction-Setting-Washing-Drying | 5 | 5 | 0.7 | o | 14200 | 576 |
| C | Reaction-Setting-Washing-Drying | 20 | 5 | 0.3 | o | 34900 | 600 (Normal) |
| D | Reaction-Setting-Washing-Drying | 20 | 5 | 0.7 | o | 48700 | 600 (Normal) |
| E | Reaction-Setting-Washing-Drying | 40 | 1 | 0.3 | o | 35600 | 600 (Normal) |
| F | Reaction-Setting-Washing-Drying | 40 | 5 | 0.3 | o | 49300 | 600 (Normal) |
| G | Reaction-Setting-Washing-Drying | 40 | 5 | 0.7 | o | 50200 | 600 (Normal) |
| H | Reaction-Setting-Washing-Drying | 80 | 1 | 0.3 | o | 51400 | 600 (Normal) |
| Comp. Ex. 5 | Reaction-Washing-Drying | — | — | — | x | 2300 | 168 |

*The same as in Table 1.
**Indications in "Appearance" and "Salt Spray Test" mean the same as in Table 1.

What we claim is:

1. An improved process of chromate treatment comprising contacting a metal surface with a chromating solution comprising a chromic acid ingredient, a halocarbon solvent and an alcohol solubilizing agent; allowing the thus treated metallic surface to stand in an atmosphere substantially free from any ingredient of said chromating solution for at least 30 seconds; thereafter washing the metal surface by contacting with a liquid and/or vapor of a solution substantially consisting of a halocarbon or a halocarbon and an alcohol; and drying said surface.

2. The process as recited in claim 1, wherein said standing is in the air.

3. The process as recited in claim 1, wherein said atmosphere is at ambient temperature.

4. The process as recited in claim 1, wherein said standing is at an elevated temperature.

5. The process as recited in claim 2, wherein said standing is carried out in a flow of air of 20° to 50° C.

6. The process as recited in claim 1, wherein the halocarbon is a chlorofluorocarbon.

7. The process as recited in claim 1, wherein the halocarbon is a chlorinated carbon.

8. The process as recited in claim 1, wherein the solubilizer is a secondary or tertiary alcohol having 3–20 carbon atoms.

9. The process as recited in claims 1, 2, 3, 4, 5, 6, 7, or 8 in which the metal surface which has been contacted with the chromate treatment solution is allowed to stand in the atmosphere substantially free from any ingredients of the chromating solution for a period of 1 to 10 minutes.

10. The process as recited in claim 1, wherein said alcohol solubilizing agent contains at least one of a stabilizer and a reaction promoter.

* * * * *

UNITED STATES PATENT AND TRADEMARK OFFICE

CERTIFICATE OF CORRECTION

PATENT NO. : 4,675,054

DATED : June 23, 1987

INVENTOR(S) : Nobuhiro Ayukawa et al.

It is certified that error appears in the above-identified patent and that said Letters Patent is hereby corrected as shown below:

Column 7 is double-spaced. This should be single-spaced.

Column 8 - Claims 9 and 10 are transposed. Claim 9 should be Claim 10 and Claim 10 should be Claim 9.

Column 8 - Claim 9 (which should be Claim 10) "claims 1,2,3,4,5,6,7, or 8" should read —claims 1-9—.

Signed and Sealed this

Nineteenth Day of January, 1988

*Attest:*

DONALD J. QUIGG

*Attesting Officer*

*Commissioner of Patents and Trademarks*